United States Patent [19]

van Houwelingen et al.

[11] Patent Number: 4,877,996

[45] Date of Patent: Oct. 31, 1989

[54] ELECTRON TUBE WITH CONTROL ELECTRODE REMOTE FROM ANODE

[75] Inventors: Dirk van Houwelingen; Jozephus J. M. Warringa, both of Heerlen, Netherlands

[73] Assignee: U.S. Philips Corporation, New York, N.Y.

[21] Appl. No.: 323,111

[22] Filed: Mar. 13, 1989

Related U.S. Application Data

[63] Continuation of Ser. No. 91,288, Aug. 27, 1987, abandoned, which is a continuation of Ser. No. 853,591, Apr. 18, 1986, abandoned.

[30] Foreign Application Priority Data

May 2, 1985 [NL] Netherlands ..... 8501242

[51] Int. Cl.[4] ..... H01J 1/46; H01J 17/12; H01J 19/38

[52] U.S. Cl. ..... 313/592; 313/294; 313/308

[58] Field of Search ..... 313/592, 597, 595, 599, 313/600, 601, 602, 603, 293, 294, 296, 300, 558, 620, 621, 632, 349, 308

[56] References Cited

U.S. PATENT DOCUMENTS

| | | | |
|---|---|---|---|
| 3,612,937 | 10/1971 | Smirnov et al. | 313/601 |
| 3,873,869 | 3/1975 | Coppola | 313/558 X |
| 3,943,398 | 3/1976 | Gerlach | 313/341 |
| 4,295,077 | 10/1981 | Carter et al. | 313/293 |

FOREIGN PATENT DOCUMENTS 625319 8/1927 France .

*Primary Examiner*—Kenneth Wieder
*Attorney, Agent, or Firm*—Robert J. Kraus

[57] ABSTRACT

An electron tube, for example, a transmitter tube of the triode type, comprising in an evacuated envelope a mesh or cage cathode (3) and an anode (1). By providing a control electrode (4) near the cathode (3) on the side thereof remote from the anode (1), the output power of the tube can be controlled by means of a potential difference between the control electrode (4) and the cathode (3).

5 Claims, 1 Drawing Sheet

ELECTRON TUBE WITH CONTROL ELECTRODE REMOTE FROM ANODE

This is a continuation of application Ser. No. 091,288, filed Aug. 28, 1987, now abandoned which is a continuation of Ser. No. 853,591, filed Apr. 18, 1986, now abandoned.

BACKGROUND OF THE INVENTION

The invention relates to an electron tube comprising in an evacuated envelope a mesh or cage cathode and an anode.

Such electron tubes have a wide field of application. They are used, for example, as diodes, triodes, or tetrodes. These tubes may have a planar structure or may be constructed coaxially. Tubes of this type are used, for example, as rectifiers and as transmitter tubes for radio and television, and also as transmitter tubes for heating purposes.

Such a tube, in particular a transmitter tube, is known from the book "Tubes for RF-heating" by H. F. Dittrich, Publications Dept. of Philips' Electronic Components and Materials Division, Eindhoven, October, 1971, which may be considered to be incorporated herein by refernece. A number of systems are described in the book (see pages 118–120) for the control of the output power of transmitter tubes. None of these systems is simple. Moreover, the systems often lead to considerable power losses. These tubes comprise a mesh or cage cathode. The grid used in these tubes also usually has a mesh or cage structure. A mesh cathode usually consists of two sets of crossing parallel wires which are welded together at the crossings. These wires usually consist of carbonized thoriated tungsten. A cage cathode consists of two sets of parallel wires crossing each other at an angle of 90°. One set of wires in such a cage cathode extends parallel to the cathode axis and is situated on a cylindrical surface. Cage cathodes are also known in which a set of wires extends parallel to the cathode axis and is situated on a cylindrical surface and one or more coils are wound around the set of wires. However, such a cathode may also be manufactured from a foil cylinder of, for example, carbonized thoriated tungsten sheet having diamondshaped, square, triangular or elongate apertures, so that a mesh or cage cathode is also obtained.

German Patent Application No. 1,639,404 laid open to public inspection discloses a transmitter tube having around an axis a tubular anode in which a cathode and a control grid are present coaxially. In the cathode a focussing electrode is accommodated which has a number of grooves extending parallel to the axis in which stripshaped cathode parts extend parallel to the axis. Flat electron beams are formed by this structure which are directed outwards radially.

SUMMARY OF THE INVENTION

It is an object of the invention to provide an improved transmitter tube, having a mesh or cage cathode, in which a substantially loss-free power control is possible.

According to the invention, a tube of the kind described in the opening paragraph is characterized in that a control electrode is provided near the cathode on the side thereof remote from the anode. This tube may have a planar structure. The tube may be a diode or a tube having one or more grids between the cathode and anode.

A first preferred embodiment of the invention is characterized in that the cathode is cylindrical or frustoconical, the anode is provided coaxially around the cathode and the control electrode is situated coaxially in the cathode. The control electrode may be a cylinder with or without apertures. In the planar structure it may be a flat plate or a flat grid. The electric field caused by a negative potential at the control electrode with respect to the cathode extends through the apertures (meshes) of the mesh or cage cathode (the so-called "Durchgriff") into the space between the cathode and the first grid or the anode. By means of this potential difference, the electron current and hence also the anode current and the output power of the tube (for example, a transmitter tube) can be controlled. Owing to the usually rather thin structure of the mesh or cage cathode, a strong "Durchgriff" can easily be realized so that a substantially loss-free power control can be obtained with comparatively low potential differences (0 to 1,500 Volts) between the control electrode and the cathode. This power control is substantially loss-free because no electron current flows through the control electrode. Such a power control is particularly suitable for transmitter tubes. The shape of the control characteristic (the power is a function of the voltage at the control electrode) can be influenced and hence be optimized. In the case of a coaxial structure optimizing may be done by, for example, causing the spacing between the cathode and the control electrode to increase with distance along the direction of the axis. In the case of a planar structure it is possible to cause the spacing to increase in one direction. The "Durchgriff" can, of course, also be influenced by varying the shape and/or the density of the apertures in the cathode.

A second preferred embodiment of the invention is characterized in that the control electrode also has a mesh or cage structure, the apertures of which are situated behind the closed parts between the apertures in the cathode. If the control electrode is composed of two sets of crossing wires, the crossings of the wires are preferably situated behind the apertures in the cathode. The control electrode may be provided with gettering material at its surface.

BRIEF DESCRIPTION OF THE DRAWING

Embodiments of the invention will now be described in greater detail, by way of example, with reference to the drawing figures, in which.

DESCRIPTION OF THE PREFERRED EMBODIMENTS

Figure 1A:
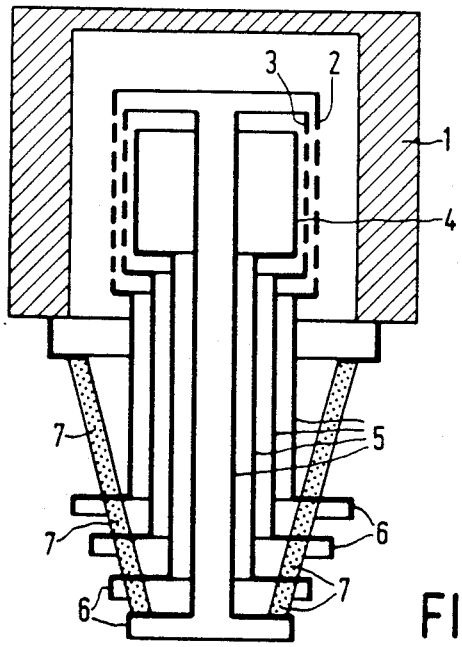
FIG. 1*a* is a diagrammatic longitudinal sectional view of a triode embodying the invention.
Figure 1B:
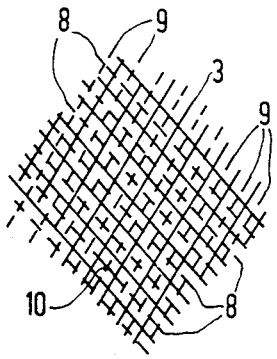
FIG. 1*b* shows a part of a control electrode behind a cathode part.

FIG. 1*a* is a diagrammatic longitudinal sectional view of a transmitter tube embodying the invention. This transmitter tube comprises a cylindrical anode 1 which can be cooled on its outside as is described inter alia in the article "Neue Generation von Senderohren", Funkschau 16, 1981, page 64. The tube further comprises a control grid 2 and a mesh cathode 3. The mesh cathode comprises, just as the cathode shown in the article in Funkschau (photograph 2), a first and a second set of parallel wires which are connected together at the crossings. The cathode may also have a cage structure, analogous to the cage grid as shown in photograph 4 from the article in Funkschau. A control electrode 4 which consists of a metal cylinder is provided in the cathode 3. As shown in FIG. 1*b*, the control electrode 4 may also be a mesh grid consisting of two sets 8 and 9 of parallel wires (the broken lines) which are connected together at the crossings 10. The crossings 10 are disposed behind the apertures in the cathode 3 which is also composed of wires (the solid lines). The control electrode 4, the cathode 3 and the grid 2 are connected to sleeves 5 of molybdenum with contact rings 6 of Kovar, which together constitute the electric connection to the exterior. The various diameters of the sleeves 5 and the contact rings 6 enable a coaxial mounting of the electrodes. Kovar is an iron-nickel-cobalt alloy the coefficient of expansion of which is comparable to that of the aluminium oxide ceramic material of which the bodies 7 between the contact rings 6 consist. The cathode of the German Patent Application No. 1,639,404 consists of a number of elongate cathode elements. The focussing electrode in the cathode comprises radially extending parts so that the cathode elements are surrounded. The control electrode 4 in the disposed tube is present behind the cathode 3 and the power is controlled by adjusting the voltage difference between electrode 4 and cathode 3 with which the extent of "Durchgriff" is adjusted. It will be obvious that the invention is not restricted to the triode shown here but that it may also be used in diodes or in tubes having more grids. Of course, the invention may also be applied in tubes in which the electrodes and cathode are frusto-conical or in tubes having flat or slightly curved electrodes and cathodes. A layer of zirconium is provided on the control electrode 4 and serves as a getter.

Figure 2:
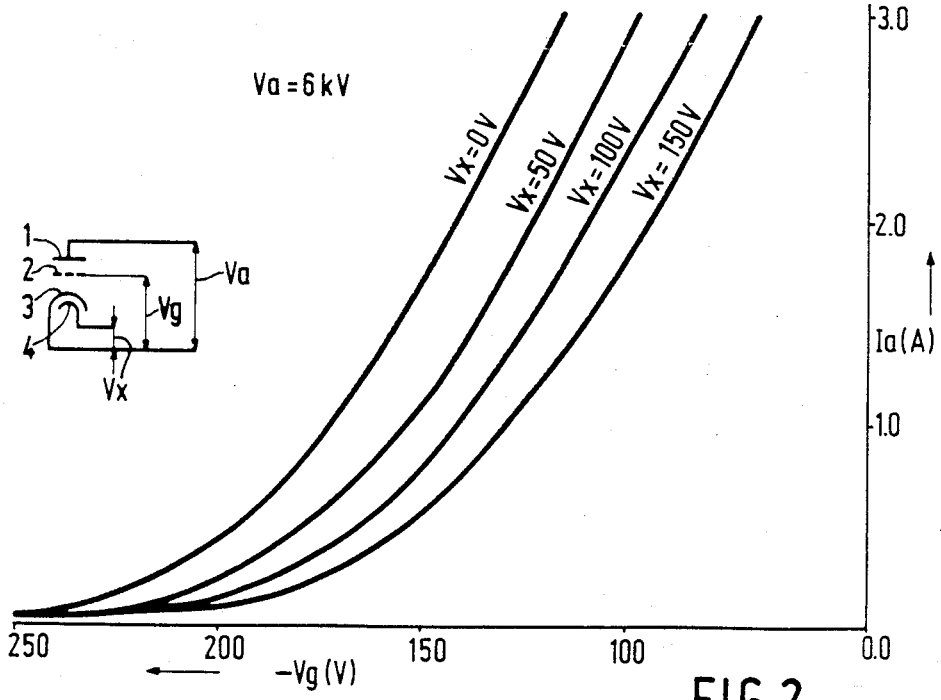
FIG. 2 shows the $I_a$–$V_g$ characteristics of such a tube with various voltages at the control electrode.

FIG. 2 shows the anode current ($i_a$) - grid voltage ($V_g$) characteristic of a tube having a voltage of 0 volts at the control electrode ($V_x$=OV). This characteristic corresponds to that of a prior art tube. By giving the control electrode a negative potential with respect to the cathode, the $I_a$–$V_g$ characteristics are shifted to lower values of $I_a$ ($V_x$=50 V, 100 V, 150 V). It is hence possible to control the output power substantially without current. It is possible to vary the "Durchgriff" over the cathode as already indicated hereinbefore. As a result of this it is possible to vary the slope of these $I_a$–$V_g$ characteristics at will. This Figure again shows the triode with control electrode, in which the reference numerals correspond to those of FIG. 1*a*. $V_a$ is the anode voltage. The above-described characteristics have been measured at $V_a$=6 KV in a modified tube of the type YD 1172 of Philips.

Another possibility of controlling the output power of the tube is by pulse duration modulation (PDM) with pulses of, for example, −1200 Volts at the control electrode.

What is claimed is:

1. An electron tube comprising an evacuated envelope containing:

a. an electron-receiving anode;

b. an electron-emitting cathode spaced from the anode for emitting an electron current which flows to the anode under the influence of an electric field in a region between the cathode and the anode, the cathode including a multiplicity of apertures extending therethrough from a side facing the anode to a remote side of said cathode; and c. a control electrode disposed adjacent the remote side of the cathode for producing an electric field extending through the apertures of the cathode and into said region;

said control electrode and said cathode being arranged with respect to each other such that the spacing therebetween varies with distance along said control electrode and affects the penetration of said electric field into said region, said spacing being dimensioned to optimize power output control of the tube as a function of a voltage applied to said control electrode.

2. An electron tube as in claim 1 where the cathode and the control electrode are arranged coaxially and where the spacing therebetween increases axially.

3. An electron tube as in claim 1 where the control electrode includes a multiplicity of apertures extending therethrough and disposed adjacent respective solid portions of the cathode.

4. An electron tube as in claim 3 where the control electrode comprises a mesh of crossing conductors defining the apertures of said control electrode, crossings of said conductors being disposed adjacent the apertures in the cathode.

5. An electron tube as in claim 1 including getter material on the control electrode.

* * * * *